US006212734B1

(12) United States Patent
Commons

(10) Patent No.: US 6,212,734 B1
(45) Date of Patent: Apr. 10, 2001

(54) ADJUSTABLE HINGE

(76) Inventor: Robert R. Commons, P.O. Box 3475, Hailey, ID (US) 83333

( * ) Notice: Subject to any disclaimer, the term of this patent is extended or adjusted under 35 U.S.C. 154(b) by 0 days.

(21) Appl. No.: 09/394,990

(22) Filed: Sep. 13, 1999

(51) Int. Cl.[7] ..... E05D 7/04
(52) U.S. Cl. ..... 16/244; 16/243
(58) Field of Search ..... 16/242, 243, 244, 16/246, 247, 248

(56) References Cited

U.S. PATENT DOCUMENTS

| | | | | |
|---|---|---|---|---|
| 442,547 | * | 12/1890 | Radler | 16/243 |
| 801,232 | * | 10/1905 | Foss | 16/243 |
| 860,615 | * | 7/1907 | Winkler | 16/248 |
| 1,563,869 | * | 12/1925 | Larson | 16/243 |
| 2,611,921 | * | 9/1952 | Weidelstam | 16/244 |
| 4,381,580 | | 5/1983 | Hellstrom et al. | 16/243 |
| 5,713,105 | | 2/1998 | Toomey | 16/245 |
| 5,755,011 | | 5/1998 | Green et al. | 16/238 |

* cited by examiner

*Primary Examiner*—Anthony Knight
*Assistant Examiner*—Robert Sandy
(74) *Attorney, Agent, or Firm*—Craig M. Korfanta

(57) ABSTRACT

An adjustable, lift-off hinge having a hinge assembly including a first hinge member and a second hinge member joined by a tension pin along a vertical rotational axis. Advantageously, the hinge has two identical hinge members enabling manufacturing with a single mold or tooling set. The present invention allows low friction, pivotal movement of the first hinge member relative to the second hinge member about the vertical rotational axis. The hinge also includes a vertical adjustment mechanism allowing for precise movement of the first hinge member relative to the second hinge member along the vertical axis and precise movement of the second hinge member relative to the first hinge member along the vertical axis.

16 Claims, 4 Drawing Sheets

ADJUSTABLE HINGE

DESCRIPTION BACKGROUND OF THE INVENTION

1. Field of the Invention

This invention relates generally to hinges for mounting a door to a frame. More particularly it relates to an adjustable, lift-off hinge which enables precise vertical positioning of the door relative to the frame and lift off removal of the door from the frame.

2. Description of Related Art

Vertically adjustable hinges for mounting a door onto a frame are generally known in the art. Some known adjustable hinges, such as those disclosed in U.S. Pat. Nos. 4,381,580, 5,755,011, 5,713,105 allow vertical adjustment of the door relative to the mounting frame along the pivotal rotational axis of the door. However, the adjustable hinges disclosed in those patents are relatively complex from a manufacturing stand point. The disclosed hinges require the fabrication of two distinct hinge members. Moreover, the mechanism for vertically adjusting the disclosed hinges is limited to a single screw element. A single screw element limits either the placement of the hinge or the ability to adjust the hinge once installed. Also, only the hinge disclosed in U.S. Pat. No. 4,381,580, allows the door to be easily removed from the frame. p Accordingly it would be advantageous to have an adjustable hinge more suitable for lower-cost manufacturing methods. It would also be advantageous to have an adjustable hinge which allows the door or other attached object to be easily removed from the frame. It would be further advantageous to have a more versatile adjustable hinge designed such that vertical adjustments can be made from more than one location on the hinge.

An improved vertically adjustable hinge incorporating the foregoing advantages would be a significant advance in the art.

SUMMARY OF THE INVENTION

This invention is directed to an adjustable, lift-off hinge. The hinge has a hinge assembly including a first hinge member and a second hinge member joined by a tension pin along a vertical rotational axis. Advantageously, the hinge has two identical hinge members enabling manufacturing with a single mold or tooling set. The present invention allows low friction, pivotal movement of the first hinge member relative to the second hinge member about the vertical rotational axis. The hinge also includes a vertical adjustment mechanism allowing for precise movement of the first hinge member relative to the second hinge member along the vertical axis and precise movement of the second hinge member relative to the first hinge member along the vertical axis.

The present invention is also directed to a hinge including first and second hinge members each having base plates and corresponding hinge sleeves. The hinge members are coupled by inserting a vertical adjustment cylinder in the bottom of the hinge sleeve of the second hinge member; inserting a steel ball in the top of the hinge sleeve of the second hinge member such that is rests on the vertical adjustment cylinder; inserting a tension pin through the top of the hinge sleeve of the first hinge member such that the tension pin protrudes out the bottom of the hinge sleeve of the fist hinge member; inserting a set screw into the top of the hinge sleeve of the first hinge member; and coupling the first and second hinge members by inserting the hinge pin protruding from the first hinge member into the top of the hinge sleeve of the second hinge member such that the tension pin makes contact with the steel ball. Each hinge member can be adjusted vertically in relation to the other along the vertical axis defined by the tension pin. The adjustments are made by altering the insertion depth of the tension pin into the hinge sleeve of the first hinge member and altering the insertion depth of the vertical adjustment cylinder inserted in the bottom of the hinge sleeve of the second hinge member. The steel ball allows for low friction adjustments, and increases the useful life of the hinge.

DETAILED DESCRIPTION

Figure 1:
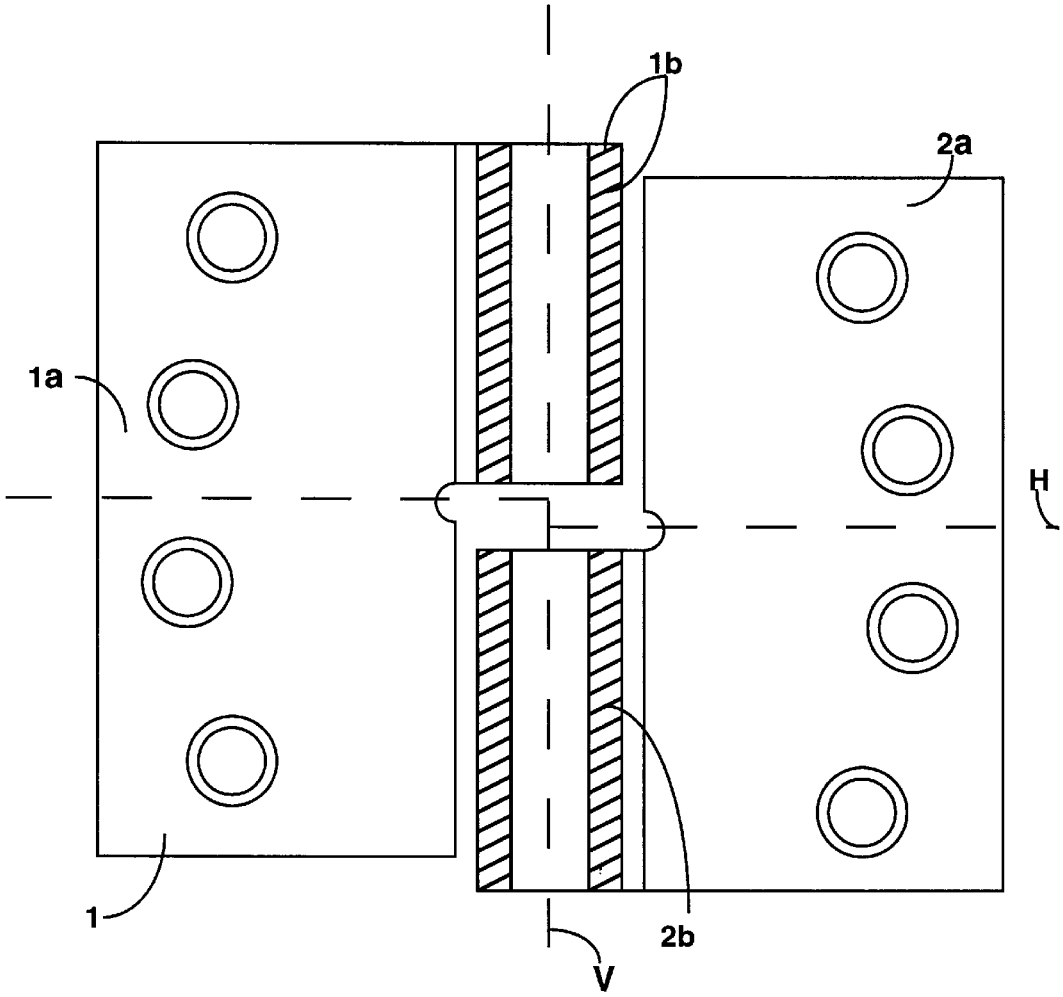
FIG. 1 is a schematic representation of an uncoupled adjustable, lift off hinge.

FIGS. 1–5 show a vertically adjustable hinge according to the invention. FIG. 1 shows the hinge body having two identical hinge members 1, 2. Each hinge member includes a base plate 1*a*, 2*a* and a hinge sleeve 1*b*, 2*b*. The first and second hinge members 1, 2 are aligned such that the second hinge member 2 is rotated 180 degrees relative to the first hinge member 1 about the center horizontal axis H so that the hinge sleeves 1*b*, 2*b* of the first and second hinge members 1, 2 align to share a common vertical rotational axis V. The base plate 1*a* of the first hinge member 1 is attachable to a door (not shown) while the base plate 2*a* of the second hinge member 2 is attachable to a supporting frame (not shown).

Figure 2:
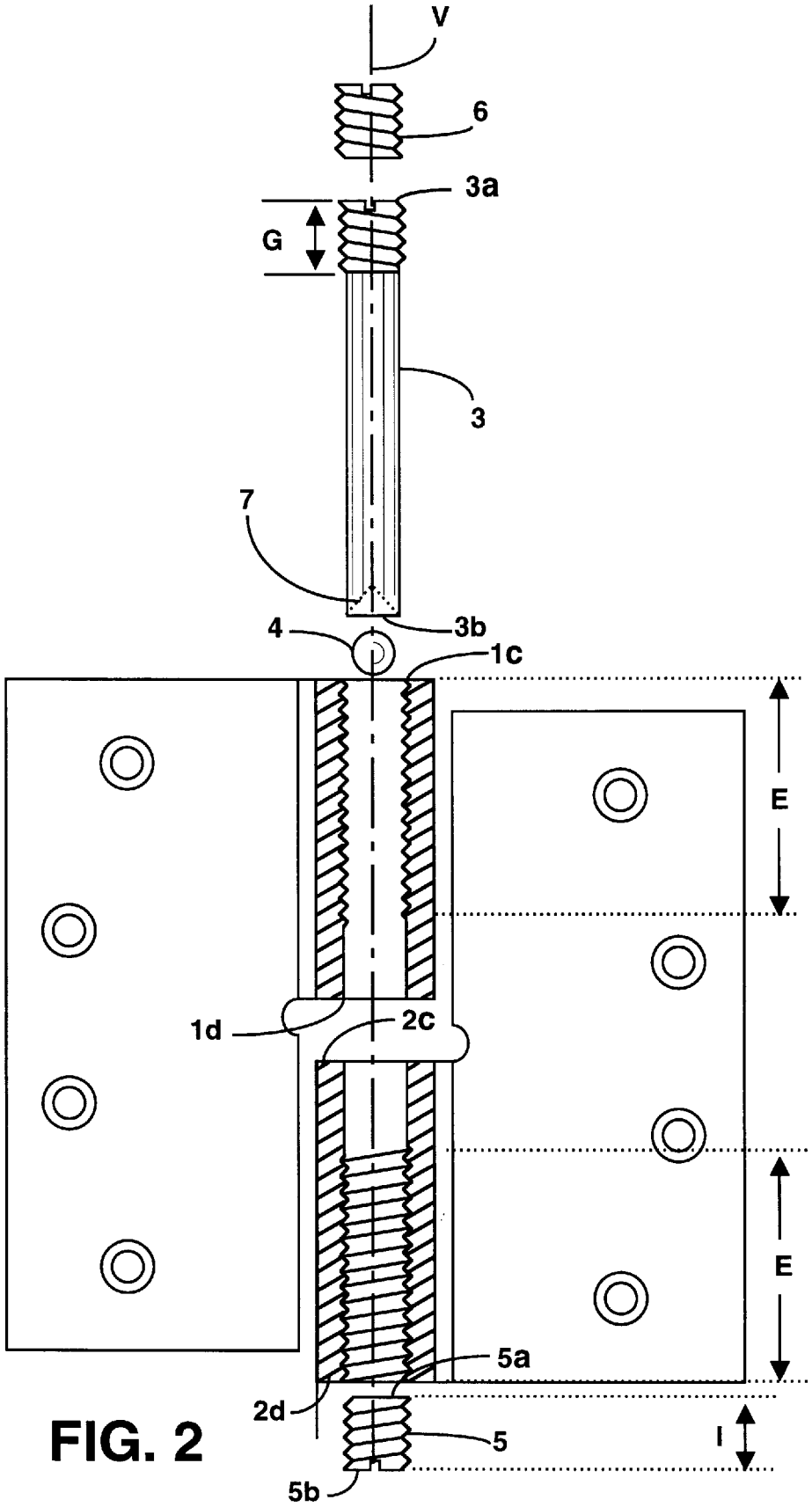
FIG. 2 is a cut-away view of an uncoupled adjustable, lift-off hinge showing the set screws, steel ball and tension pin.
Figure 3:
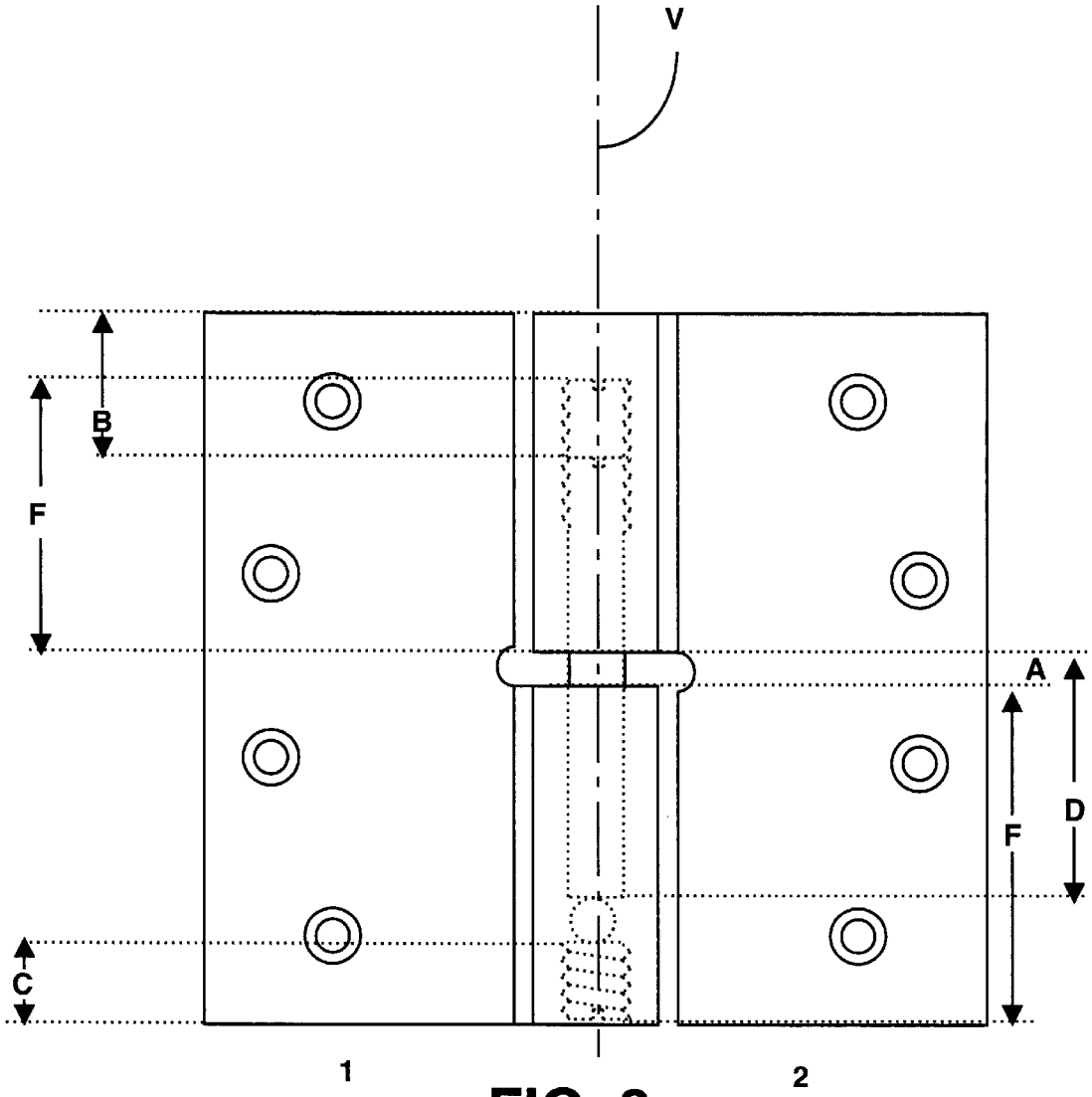
FIG. 3 is a schematic representation of a coupled adjustable, lift-off hinge.
Figure 4:
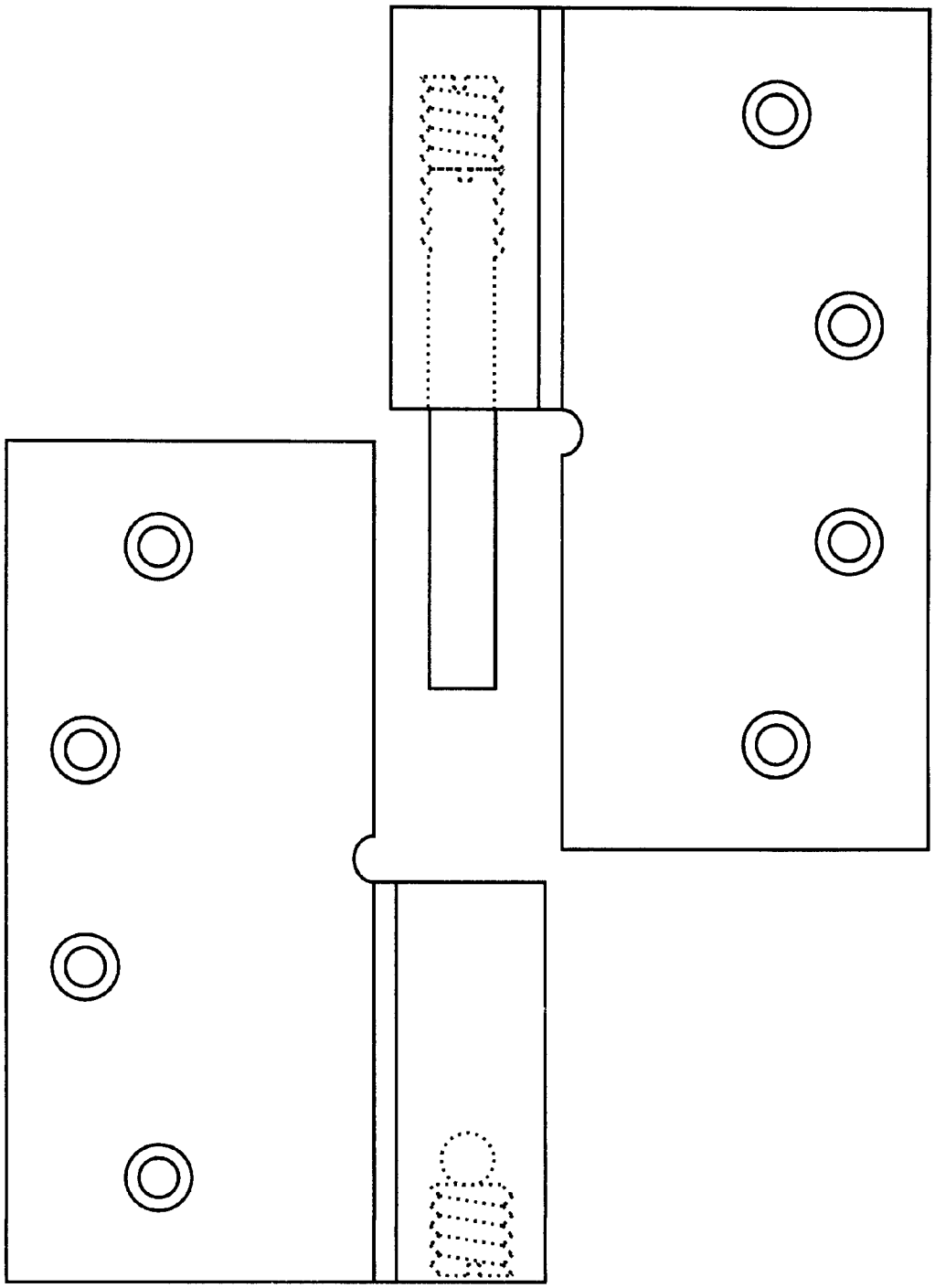
FIG. 4 is a cut-away view of an uncoupled adjustable, lift-off hinge.

FIG. 2 shows the vertical adjustable coupling mechanism for the hinge body. The adjustable coupling mechanism includes a cylindrical tension pin 3, a steel ball 4, a vertical adjustment cylinder 5, and a hinge sleeve cap 6. The first and second hinge members of the hinge body are removably coupled by inserting vertical adjustment cylinder 5 into the bottom 2*d* of the hinge sleeve 2*b* of the second hinge member 2 while placing the steel ball 4 inside the hinge sleeve 2*b* of the second hinge member 2 on the upper surface 5*a* of the vertical adjustment cylinder 5. A tension pin 3 is then inserted into the top 1*c* of the hinge sleeve 1*b* of the first hinge member 1 such that the second end 3*b* of the tension pin 3 protrudes from the bottom 1*d* of the hinge sleeve 1*b* of the first hinge member 1. A hinge sleeve cap 6 is inserted into the top 1*c* of the hinge sleeve 1*b* of the first hinge member 1 preventing debris from entering the hinge sleeves. The hinge members 1, 2 are removably coupled by inserting the second end 3*b* of the tension pin 3 protruding from the bottom 1*d* of the hinge sleeve 1*b* of the first hinge member 1 into the top 2*c* of the hinge sleeve 2*b* of the second hinge member 2 such that the second end 3*b* of the tension pin 3 makes contact with the steel ball 4 inside the hinge sleeve 2*b* of the second hinge member 2.

Vertical adjustments are affected by altering the vertical gap A between the top 2*c* of the hinge sleeve 2*b* of the second hinge member 2 and the bottom 1*d* of the hinge sleeve 1*b* of the first hinge member 1. This adjustment can be affected in at least two ways, adjusting the depth B of the tension pin 3 in the hinge sleeve 1*b* of the first hinge member 1 or adjusting the depth C of the vertical adjustment cylinder 5 in the hinge sleeve 2*b* of the second hinge member 2.

In another embodiment the hinge sleeves 1*b*, 2*b* of the first and second hinge members 1, 2 are internally threaded, the tension pin 3 is externally threaded on the first end 3*a*, and the vertical adjustment cylinder 5 is externally threaded. Consequently, depth B adjustments of the tension pin 3 are affected by turning the tension pin 3 about the vertical rotational axis V. The threaded end of the tension pin 3*a* engages the threaded portion of the hinge sleeve 2*b* of the first hinge member 2 thereby affecting a coordinated relative vertical movement of the tension pin 3 along the vertical rotational axis V in either direction. This adjustment increases or decreases, depending on the direction of rotation of the tension pin, the vertical distance D the second end 3*b* of the tension pin 3 protrudes from the bottom 1*d* of the hinge sleeve 1*b* of the first hinge member 1. As the second end 3*b* of the tension pin 3 makes contact with the steel ball 4 located in the hinge sleeve 2*b* of the second hinge member 2, the change in the distance D that the second end 3*b* of the tension pin 3 protrudes from the bottom 1*d* of the hinge sleeve 1*b* of the first hinge member 1 correspondingly increases or decreases the vertical gap A between the top 2*c* of the hinge sleeve 2*b* of the second hinge member 2 and the bottom 1*d* of the hinge sleeve 1*b* of the first hinge member 1. The steel ball 4 allows easy, precise adjustments by reducing the force required to rotate the tension pin 3 about the vertical rotational axis V as well as efficient operation of the hinge.

Depth C adjustments of the vertical adjustment cylinder 5 inserted in the bottom 2*d* of the hinge sleeve 2*b* of the second hinge member 2 are similarly affected by rotating the vertical adjustment cylinder 5 about the vertical rotational axis V. The threads of the vertical adjustment cylinder 5 engage the threaded portion of the hinge sleeve 2*b* of the second hinge member 2 thereby affecting a coordinated relative vertical movement of the vertical adjustment cylinder 5 along the vertical rotational axis V in either direction. The vertical adjustment cylinder 5 in the hinge sleeve 2*b* of the second hinge member 2 makes contact with the steel ball 4 which in turn makes contact with the second end 3*b* of the tension pin 3. The depth C of the vertical adjustment cylinder 5 in the hinge sleeve 2*b* of the second hinge member 2, thus, determines the depth D to which the second end 3*b* of the tension pin protruding from the bottom 1*d* of the hinge sleeve 1*b* of the first hinge member 1 is inserted into the top 2*c* of the hinge sleeve 2*b* of the second hinge member 2. Accordingly, adjustments to the depth C of the vertical adjustment cylinder 5 in the hinge sleeve 2*b* of the second hinge member 2 correspondingly increases or decreases the vertical gap A between the top 2*c* of the hinge sleeve 2*b* of the second hinge member 2 and the bottom 1*d* of the hinge sleeve 1*b* of the first hinge member 1. The steel ball 4 allows easy, precise vertical adjustments reducing the force required to rotate the vertical adjustment cylinder 5 about the vertical rotational axis V in the hinge sleeve 2*b* of the second hinge member 2.

It may often times be necessary to remove the door (not shown) or other object (not shown) from the supporting frame (not shown). In another embodiment, the door or other object attached to the first hinge member 1 can be easily uncoupled from the second hinge member 2. This is accomplished by moving the door or other object in a upward direction parallel to the vertical rotational axis V. Such movement causes the second end 3*b* of the tension pin 3 protruding from the bottom 1*d* of the hinge sleeve 1*b* of the first hinge member 1 to slide out of the top 2*c* of the hinge sleeve 2*b* of the second hinge member 2.

In another embodiment, the hinge sleeves 1*b*, 2*b* of the first and second hinge members 1, 2 are partially threaded to a specified depth E. This specified depth is measured from the top 1*c* of the hinge sleeve 1*b* of the first hinge member 1 along the vertical rotational axis V and from the bottom 2*d* of the hinge sleeve 2*b* of the second hinge member 2 along the vertical rotational axis V. This specified depth E is less than the length F of each hinge sleeve 1*b*, 2*b* measured along the vertical axis V, but greater than the length G of the threaded end 3*a* of the tension pin 3 and the length I of the vertical adjustment cylinder 5. This partial threading prevents over adjustment of the vertical adjustment cylinder 5 in the hinge sleeve 2*b* of the second hinge member 2 as well as over adjustment of the tension pin 3 in the hinge sleeve 1*b* of the first hinge member 1. Over adjustments could decrease the structural integrity of the hinge.

In another embodiment, the hinge sleeve cap 6, the bottom end 5*b*of the vertical adjustment cylinder 5, and the threaded end 3*a* of the tension pin 3 have an Allen or hex head to reduce the likelihood of stripping the hinge sleeve cap 6, the vertical adjustment cylinder 5, and the tension pin 3 during adjustment. Nevertheless, any other type head of like effect known in the art can also be used.

In another embodiment, an inverted cone 7 is bored into the second end 3*b* of the tension pin 3 minimally increasing the surface area of contact between the steel ball 4 and the tension pin 3 while decreasing unwanted horizontal shifting of the tension pin 3 within the hinge sleeves 1*b*, 2*b* of the first and second hinge members 1, 2.

While various embodiments of the invention is shown and described, it is envisioned that those skilled in the art may devise various modifications and equivalents without departing from the spirit and scope of the invention as defined by the appended claims. The invention is not intended to be limited by the foregoing disclosure.

I claim:

1. A vertically adjustable hinge for pivotally mounting a door or other object to a frame or other structure, comprising:

a pair of identical hinge members, here designated as first and second hinge members, each incorporating a base plate and a hinge sleeve;

a tension pin with a first and second end, said second end of said tension pin being insertable through the top of the hinge sleeve of said first hinge member and extending into the top of the hinge sleeve of said second hinge member, the tension pin defining a vertical rotational axis;

a vertical adjustment cylinder insertable into the hinge sleeve of said second hinge member;

whereby altering the position of said vertical adjustment cylinder within the hinge sleeve of said second hinge member alters the position of said second hinge member relative to the position of said first hinge member along said vertical rotational axis.

2. The vertically adjustable hinge of claim 1 wherein said hinge sleeve on said second hinge member is internally threaded and said vertical adjustment cylinder is externally threaded, whereby said externally threaded vertical adjustment cylinder is threadably received into the hinge sleeve of said second hinge member along said vertical rotational axis.

3. The vertically adjustable hinge of claim 2 wherein said hinge sleeve on said first hinge member is internally threaded and said tension pin is externally threaded whereby said tension pin is threadably received into the hinge sleeves of said first and second hinge members and alteration of the position of said tension pin within the hinge sleeve of said first hinge member alters the position of said first hinge member in relation to said second hinge member along said vertical rotational axis.

4. The vertically adjustable hinge of claim 3 wherein;

the internally threaded portion of the hinge sleeve of said first hinge members extends a fixed distance shorter than the length of the hinge sleeve of said first hinge member measured from the top of the hinge sleeve of said first hinge member along said vertical rotational axis;

the internally threaded portion of the hinge sleeve of said second hinge member extends the same said fixed distance, shorter than the length of the hinge sleeve of said second hinge member and measured from the bottom of the hinge sleeve of said second hinge member along said vertical rotational axis; and the external threading of said tension pin extends a distance shorter than said fixed distance measured from the first end of said tension pin along the vertical axis of said tension pin;

whereby the second end of said tension pin is inserted through the hinge sleeve of said first hinge member and the first end of said tension pin is threadably received into the top of the hinge sleeve of the first hinge member, and said tension pin once threadably received is selectively moveable a distance along a portion of said vertical rotational axis defined by the length of internal threading of the hinge sleeve of said first hinge member, and said vertical adjustment cylinder is threadably received into the bottom of the hinge sleeve of said second hinge member and once threadably received is selectively moveable a distance along said vertical rotational axis defined by the length of internal threading of the hinge sleeve of the second hinge member.

5. The vertically adjustable hinge of claim 4 further comprising a ball insertable into the hinge sleeve of said second hinge member whereby said ball makes contact with the second end of said tension pin and said vertical adjustment cylinder thereby reducing the force required alter the position of said vertical adjustment cylinder and said tension pin.

6. The vertically adjustable hinge of claim 5 wherein said tension pin has an inverted cone bored into the second end whereby said inverted cone accepts said ball providing multiple contact points between the second end of said tension pin and said ball.

7. The vertically adjustable hinge of claim 4 wherein:

the first end of said tension pin is configured to receive a rotational tool for adjusting the depth of said tension pin in the hinge sleeve of said first hinge member and said vertical adjustment cylinder is configured to receive a rotational tool for adjusting the depth of said vertical adjustment cylinder in the hinge sleeve of said second hinge member.

8. The vertically adjustable hinge of claim 7 where the first end of the tension pin and an end of the vertical adjustment cylinder are configured to receive a hex head rotational tool.

9. The vertically adjustable hinge of claim 7 where the first end of the tension pin and an end of the vertical adjustment cylinder are configured to receive a Phillips head rotational tool.

10. The vertically adjustable hinge of claim 7 where the first end of the tension pin and an end of the vertical adjustment cylinder are configured to receive a slotted head rotational tool.

11. The vertically adjustable hinge of claim 3 further comprising a ball insertable into the hinge sleeve of said second hinge member whereby said ball makes contact with the second end of said tension pin and said vertical adjustment cylinder thereby reducing the force required alter the position of said vertical adjustment cylinder and said tension pin.

12. The vertically adjustable hinge of claim 11 wherein said tension pin has an inverted cone bored into the second end whereby said inverted cone accepts said ball providing multiple contact points between the second end of said tension pin and said ball.

13. The vertically adjustable hinge of claim 2 further comprising a ball insertable into the hinge sleeve of said second hinge member whereby said ball makes contact with the second end of said tension pin and said vertical adjustment cylinder thereby reducing the force required alter the position of said vertical adjustment cylinder and said tension pin.

14. The vertically adjustable hinge of claim 13 wherein said tension pin has an inverted cone bored into the second end whereby said inverted cone accepts said ball providing multiple contact points between the second end of said tension pin and said ball.

15. The vertically adjustable hinge of claim 1 further comprising a ball insertable into the hinge sleeve of said second hinge member whereby said ball makes contact with the second end of said tension pin and said vertical adjustment cylinder thereby reducing the force required alter the position of said vertical adjustment cylinder and said tension pin.

16. The vertically adjustable hinge of claim 15 wherein said tension pin has an inverted cone bored into the second end whereby said inverted cone accepts said ball providing multiple contact points between the second end of said tension pin and said ball.

* * * * *